US008677568B2

(12) United States Patent
Sutterlütti

(10) Patent No.: US 8,677,568 B2
(45) Date of Patent: Mar. 25, 2014

(54) FURNITURE HINGE

(75) Inventor: Harald Sutterlütti, Fussach (AT)

(73) Assignee: Julius Blum GmbH, Hochst (AT)

( * ) Notice: Subject to any disclaimer, the term of this patent is extended or adjusted under 35 U.S.C. 154(b) by 1139 days.

(21) Appl. No.: 12/078,046

(22) Filed: Mar. 26, 2008

(65) Prior Publication Data

US 2008/0172834 A1 Jul. 24, 2008

Related U.S. Application Data

(63) Continuation of application No. PCT/AT2006/000330, filed on Aug. 4, 2006.

(30) Foreign Application Priority Data

Sep. 28, 2005 (AT) ..... A 1588/2005

(51) Int. Cl.
*E05D 7/00* (2006.01)

(52) U.S. Cl.
USPC ..... 16/354; 16/49; 312/319.5

(58) Field of Classification Search
USPC ..... 16/286, 287, 366, 368, 302, 282, 294, 16/277, 49, 50, 54, 68, 288, 370; 312/326, 312/114, 116, 138.1, 139, 319.5, 321.5; 49/381, 246, 254, 334, 340, 349, 341
See application file for complete search history.

(56) References Cited

U.S. PATENT DOCUMENTS 2,912,237 A * 11/1959 Snyder ..... 49/199
3,091,426 A * 5/1963 Bogart ..... 248/393
4,440,364 A * 4/1984 Cone et al. ..... 244/129.6
4,497,462 A * 2/1985 Hamatani ..... 244/129.5
4,651,960 A * 3/1987 Mauersberger et al. . 248/123.11
4,929,146 A * 5/1990 Koster et al. ..... 414/744.5
5,012,551 A * 5/1991 Beneke et al. ..... 16/49
5,112,118 A * 5/1992 Wiehle ..... 312/116
6,045,204 A * 4/2000 Frazier et al. ..... 312/247
6,505,381 B1 * 1/2003 Thomson et al. ..... 16/302
6,513,617 B2 * 2/2003 Sasaki et al. ..... 180/274
6,591,454 B2 * 7/2003 Brustle ..... 16/374
6,877,791 B2 * 4/2005 Greuel et al. ..... 296/146.4

(Continued)

FOREIGN PATENT DOCUMENTS

DE 93 19 914 U1 5/1994
DE 103 41 999 A1 4/2005

(Continued)

OTHER PUBLICATIONS

Austrian Search Report (and Translation) issued May 5, 2006 in the Austrian Patent Office.

(Continued)

*Primary Examiner* — William Miller
(74) *Attorney, Agent, or Firm* — Wenderoth, Lind & Ponack, L.L.P.

(57) ABSTRACT

A furniture hinge is provided for pivotally connecting at least two parts of a piece of furniture. The furniture hinge includes at least two fastening pieces which can be fixed to one part of the piece of furniture, respectively, and can be hingedly joined to each other via at least one articulated shaft. The inventive furniture hinge further includes at least one motor, preferably an electric motor, for swiveling the fastening pieces.

29 Claims, 16 Drawing Sheets

(56) References Cited

U.S. PATENT DOCUMENTS

| | | | | |
|---|---|---|---|---|
| 7,065,833 | B2 * | 6/2006 | Kropf | 16/286 |
| 7,275,284 | B2 * | 10/2007 | Lautenschlager et al. | 16/287 |
| 7,552,509 | B2 * | 6/2009 | Chen et al. | 16/50 |
| 7,562,416 | B2 * | 7/2009 | Lautenschlager et al. | 16/286 |
| 7,669,285 | B2 * | 3/2010 | Gallasch et al. | 16/286 |
| 7,832,057 | B2 * | 11/2010 | Hoffman | 16/367 |
| 7,971,393 | B2 * | 7/2011 | Gao et al. | 49/386 |
| 2001/0016967 | A1 | 8/2001 | Isele | |
| 2002/0046441 | A1 | 4/2002 | Brustle | |
| 2004/0090083 | A1 * | 5/2004 | Greuel et al. | 296/146.4 |
| 2004/0097318 | A1 * | 5/2004 | Greuel et al. | 475/149 |
| 2005/0017224 | A1 * | 1/2005 | Salice | 254/1 |
| 2005/0067925 | A1 * | 3/2005 | Stone, III | 312/249.2 |
| 2007/0157431 | A1 * | 7/2007 | Bertani | 16/262 |
| 2008/0238276 | A1 * | 10/2008 | Migli | 312/326 |

FOREIGN PATENT DOCUMENTS

| | | | |
|---|---|---|---|
| EP | 1 128 012 | A | 8/2001 |
| EP | 1 199 443 | A2 | 4/2002 |
| FR | 2 741 905 | A | 6/1997 |
| GB | 211990 | | 3/1924 |
| JP | 11-62360 | | 3/1999 |
| JP | 11324483 | A | 11/1999 |
| WO | 03/097979 | A1 | 11/2003 |
| WO | 2004/065740 | | 8/2004 |
| WO | 2004/083580 | A1 | 9/2004 |

OTHER PUBLICATIONS

International Search Report issued Nov. 30, 2006 in the International (PCT) Application of which the present application is the U.S. National Stage, Application No. PCT/AT2006/000330.

* cited by examiner

FURNITURE HINGE

This application is a continuation of International Application No. PCT/AT2006/000330, filed Aug. 4, 2006.

BACKGROUND OF THE INVENTION

The present invention relates to a furniture hinge for pivotably connecting at least two parts of an item of furniture comprising at least two stop parts which can each be fastened to one part of the item of furniture and can be articulated to one another via at least one articulated axle.

Mechanical dampers and closing devices are known in furniture hinges. However, the dampers and closing devices influence the movement of the parts of the item of furniture which are connected via a furniture hinge only in a small angular range of the closing or opening movement. The remaining swiveling of the parts of the item of furniture is in the prior art still carried out manually.

The object of the invention is to find a more convenient solution to this problem.

SUMMARY OF THE INVENTION

According to the invention, this is achieved in that the furniture hinge has at least one motor, preferably an electric motor, for swiveling the stop parts.

Furniture hinges are usually hinges comprising a hinge cup and/or a hinge arm as a stop part. However, in addition, frame hinges are also known. Often, the stop parts can be clipped onto a base plate which can be fastened to a part of the item of furniture. There are furniture hinges comprising one or more articulated axles. Use is often made of furniture hinges in which the stop parts can be joined together via four or seven articulated axles. These are usually hinges comprising two articulated levers, provision often being made in the case of what are known as wide-angle hinges comprising seven articulated axles for at least one articulated lever to have two legs which can be swiveled relative to each other via an articulated axle. A basic property of all furniture hinges is their dual operation. On the one hand, they carry the pivotable part of the item of furniture, while on the other hand they allow and also lead the pivoting movements. According to the invention, furniture hinges now additionally have at least a third function, namely the motor-driving of the swiveling.

The motors which are preferably used for swiveling the stop parts have a motor housing and at least one motor shaft, and the motor shaft can be mounted so as to be rotatable or longitudinally displaceable with respect to the motor housing. In the case of furniture hinges, use may be made, as the exemplary embodiments will reveal in greater detail, both of rotational motors and of linear motors. Both can be configured as both a DC and as an AC motor. For furniture hinges, it is often sufficient to provide motors having comparatively low operating voltages, preferably DC voltages, of between 5 volts and 25 volts, preferably of 24 volts. The electric powers provided by the motor are usually between 2 and 30 watts, preferably between 4 and 20 watts.

The motor can be used not only for swiveling the stop parts during opening or closing, but also for damping or braking the opening and/or closing movement. For this purpose, the motor can be loaded both inductively and with an ohmic resistance. However, the maximum damping effect is achieved by simple short-circuiting of the motor.

The output or the motor shaft of the motor can directly drive an articulated lever or an articulated axle of the hinge. However, transmission mechanisms can also be provided. In addition, it is beneficial, as will be described hereinafter in detail, if there is arranged in the output of the motor a preferably electromagnetic coupling which is switchable, preferably electrically, at least between a closed state in which it transmits a force or a torque of the motor and an opened state in which it transmits no force or no torque of the motor. Instead of or in addition to the coupling, furniture hinges and preferably also motors comprising a free-wheel, which can preferably be switched on and off, can also be used, for example in order in the event of a power failure still to be able to move the hinge by hand.

BRIEF DESCRIPTION OF THE DRAWINGS

Further advantages and details of the present invention will emerge from the following description of the figures, in which.

DETAILED DESCRIPTION OF THE INVENTION

Figure 1:
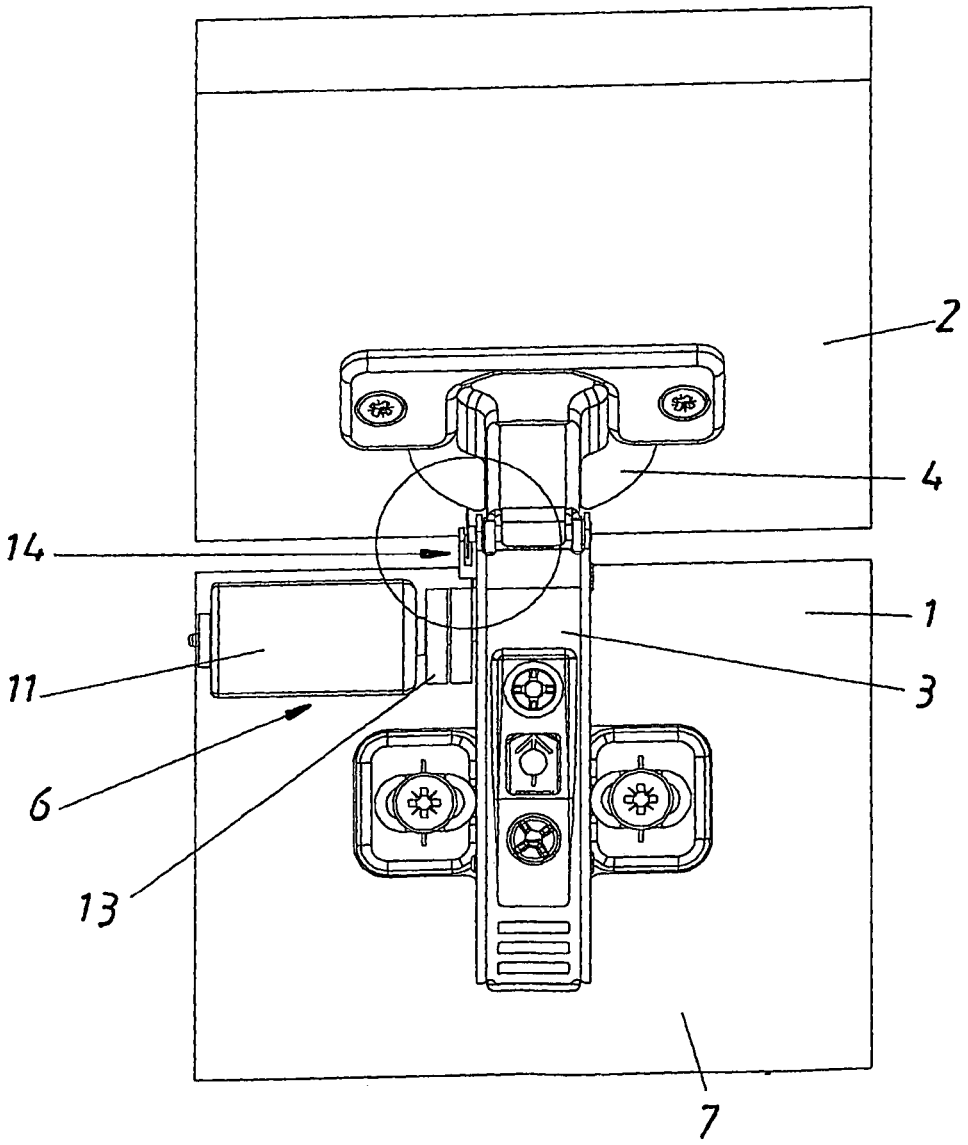
FIGS. 1 to 5 show a first example according to the invention of how a motor can be arranged on the hinge.
Figure 3:
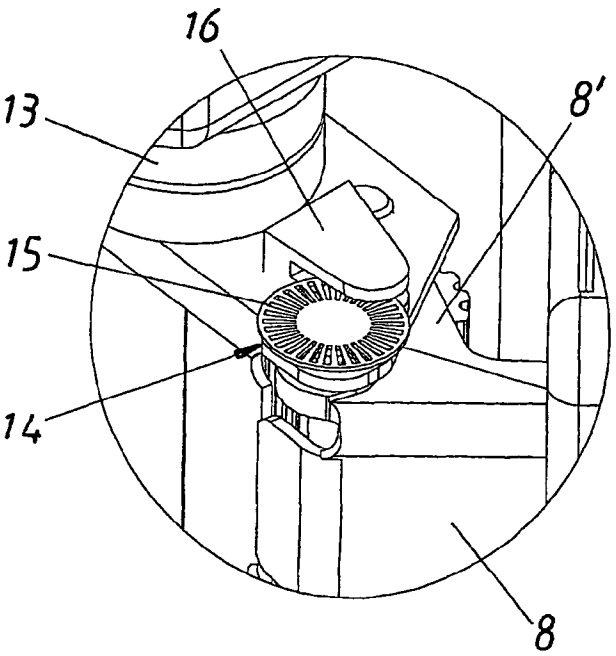
Figure 2:
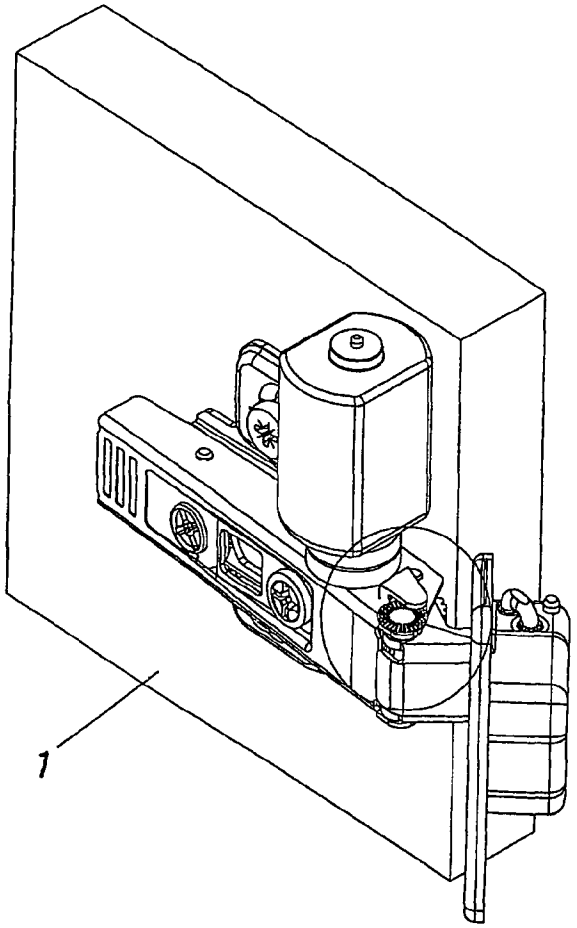

Various examples of how motors can according to the invention be arranged on various types of hinges will first be shown with reference to FIGS. 1 to 15.

FIGS. 1 to 5 show an embodiment in which an electric motor 6 is arranged laterally on the hinge arm 3. The hinge arm 3 itself can be clipped, as is known per se, onto a base plate 7 which is secured in the part 1 of the item of furniture. However, any other fastening variation known in the art is also possible. The motor housing 11 of the motor 6 is in this case fixed to the hinge arm 3. However, the housing 11 could also be arranged on any other stop part. A, preferably electrically, switchable coupling 13 is provided in the output of the motor between a first gear-wheel 17 and the motor on the motor shaft 12. The coupling is switchable at least between two states. In what is known as the closed state, a force or a torque of the motor 6 is transmitted, whereas in what is known as the opened state no force or no torque is transmitted from the motor. In addition, provision is beneficially made for the intensity of the coupling force to be variable. Furthermore, the output, in the form of the motor shaft 12, can if necessary also interact with a transmission mechanism of a more complex configuration. Beneficially, electromagnetic couplings 13 are used, as these can be designed very small and easily activated.

The forces or torque are transmitted, when the coupling 13 is closed, from the first gear-wheel 17 to a second gear-wheel 19 which is rigidly connected to the inner lever 8' via the articulated axle 5'. In this way, a rotational movement produced by the motor 6 can be transmitted into a swiveling of the articulated lever 8', allowing the two stop parts—in this case the hinge arm 3 and the hinge cup 4—and thus also the two parts 1 and 2 of the item of furniture to be swiveled toward each other. In this exemplary embodiment, the transmission of the rotational movement via the transmission mechanism formed from the gear-wheels 17 and 19 was selected for reasons of space in such a way as to prevent a collision between the motor 6 and the part 2 of the item of furniture during opening and closing. However, a transmission mechanism can also be used to gear down or up the rotational movement of the motor if correspondingly higher or lower torques are required. However, if an appropriate amount of space were available, the motor could also be flanged directly onto the axle 5' of the inner articulated lever 8' or the outer articulated lever 8. It is also conceivable to use other rotary axles 5 to transmit the forces.

In this exemplary embodiment, an encoder 14, which has an encoder disc 15 and a light sensor 16, is provided to determine the actual position and/or the actual speed. Alternatively, the movement or position sensor used could also be a potentiometer or the like. It is beneficial to use angle or length measurement systems which measure on an absolute basis and can determine the absolute position of the articulated levers 8' or axles 5', and thus the absolute position of the stop parts, relative to one another even after switching-off of power or a power failure. As will be described hereinafter with reference to various control diagrams, the sensors described can be used both for determining position and speed, and as switches for triggering or stopping a movement. In exemplary embodiments like that of FIGS. 1 to 5, the motor shaft 12 is arranged coaxially with or parallel to the or one of the articulated axles 5, 5'.

Figure 4:
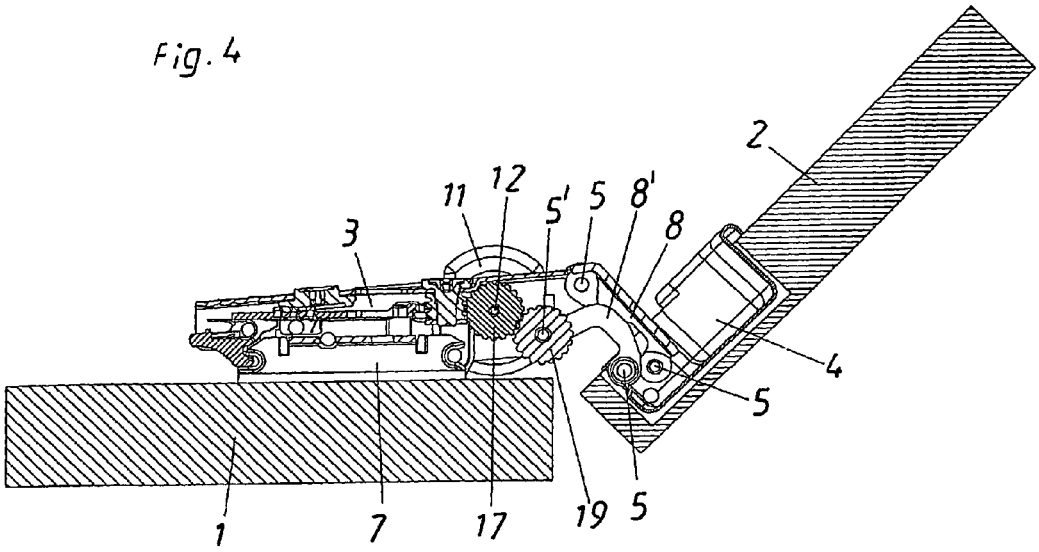
Figure 5:
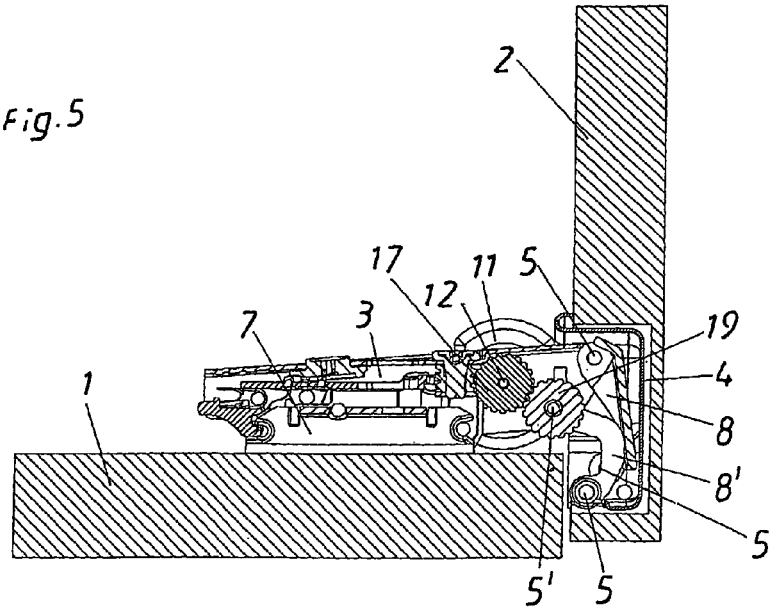
Figure 6:
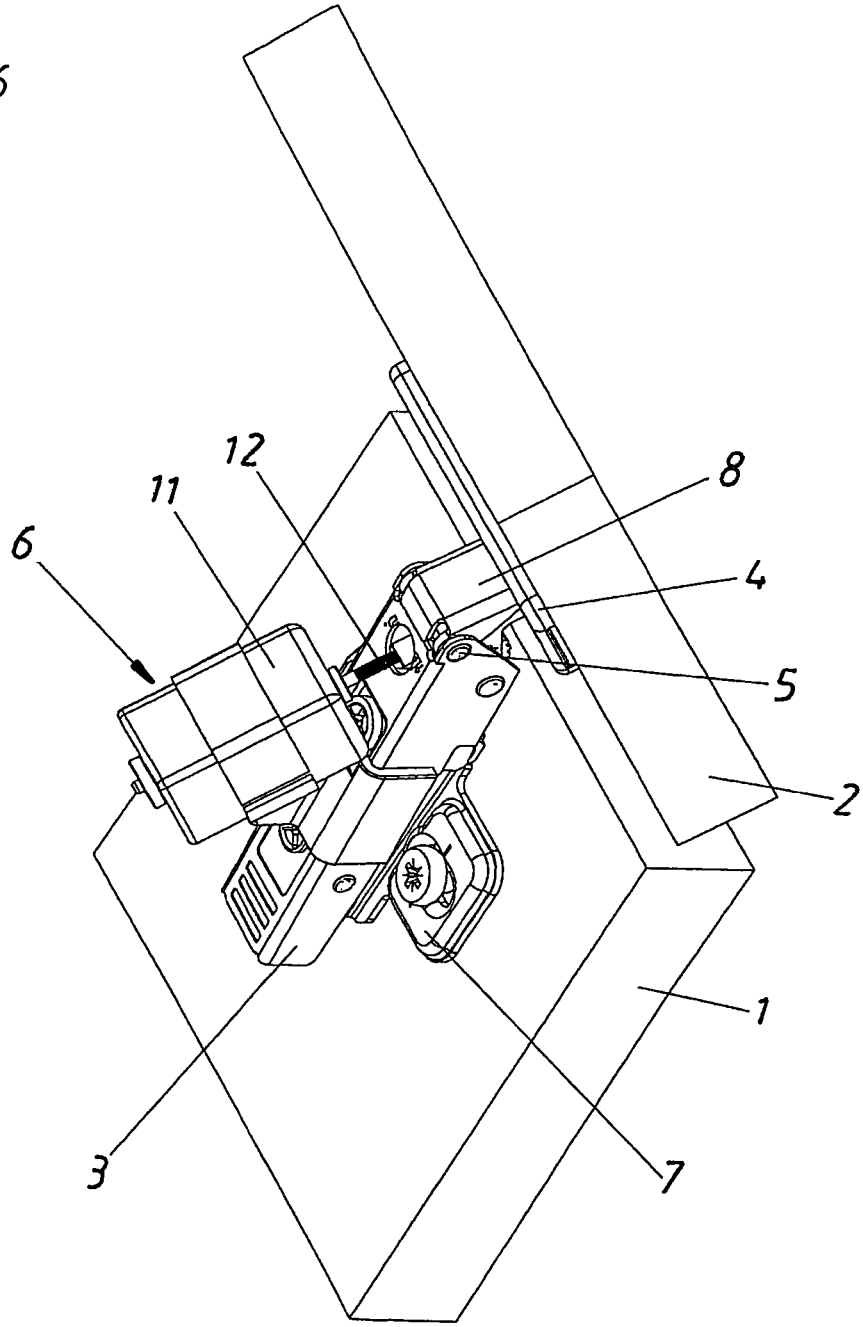
FIGS. 6 to 8 show an alternative form of the arrangement in the form of a second exemplary embodiment.
Figure 7:
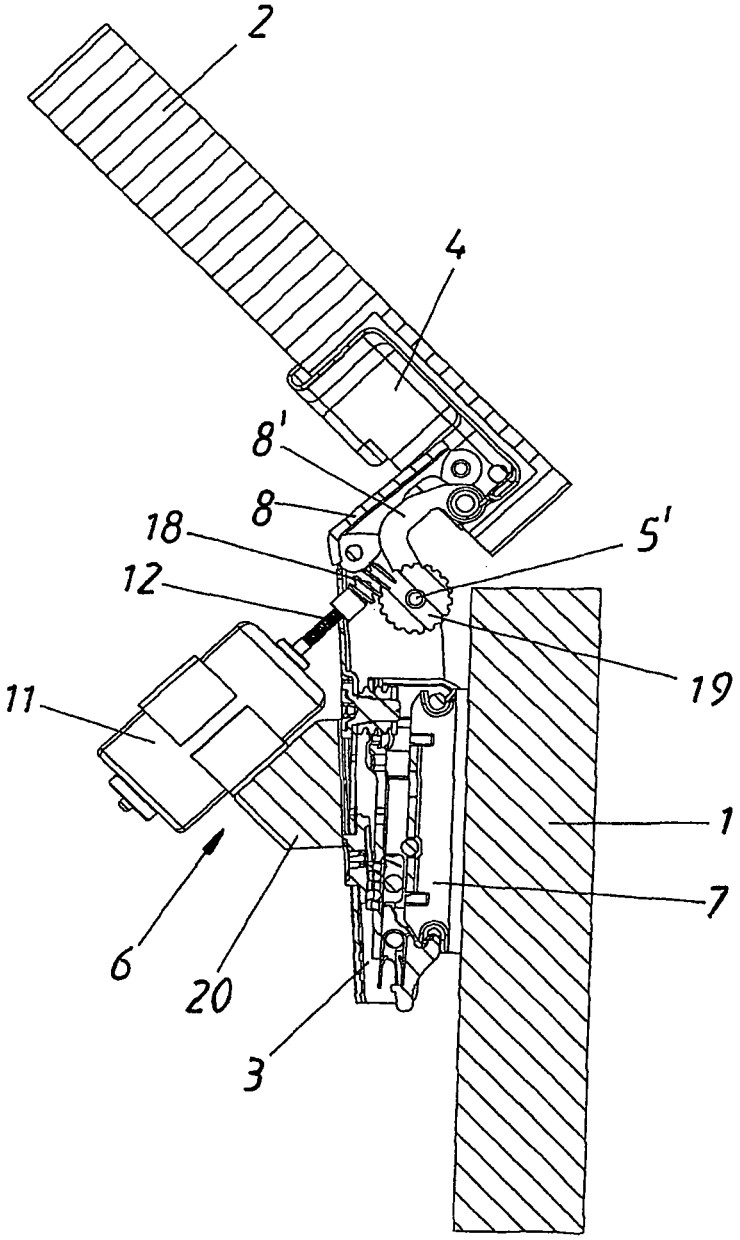
Figure 8:
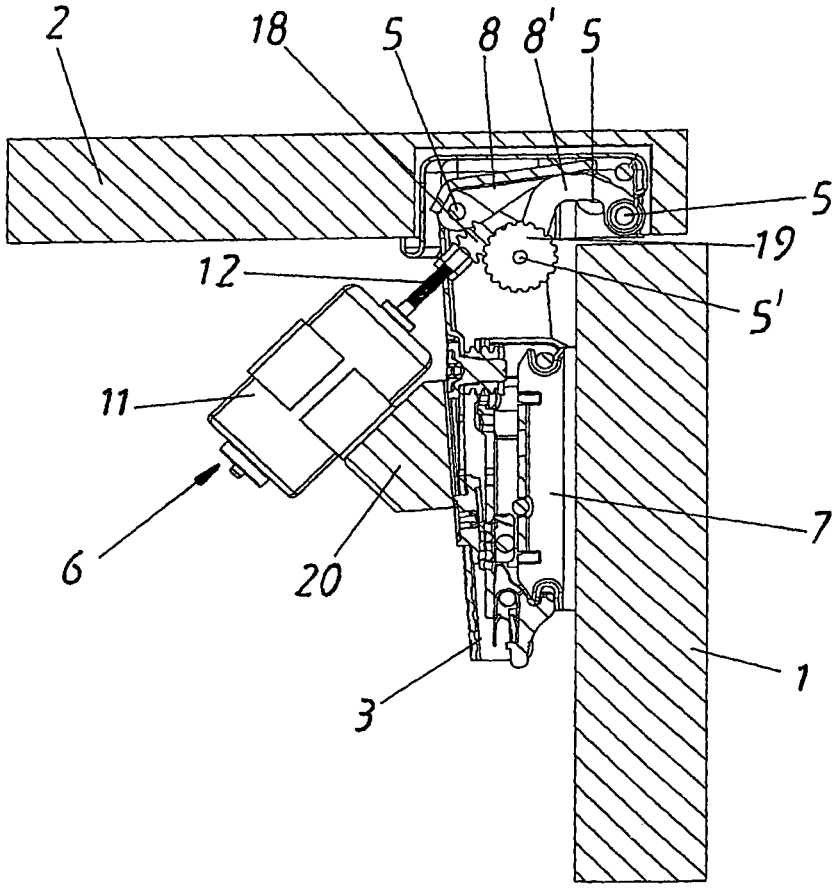
Figure 9:
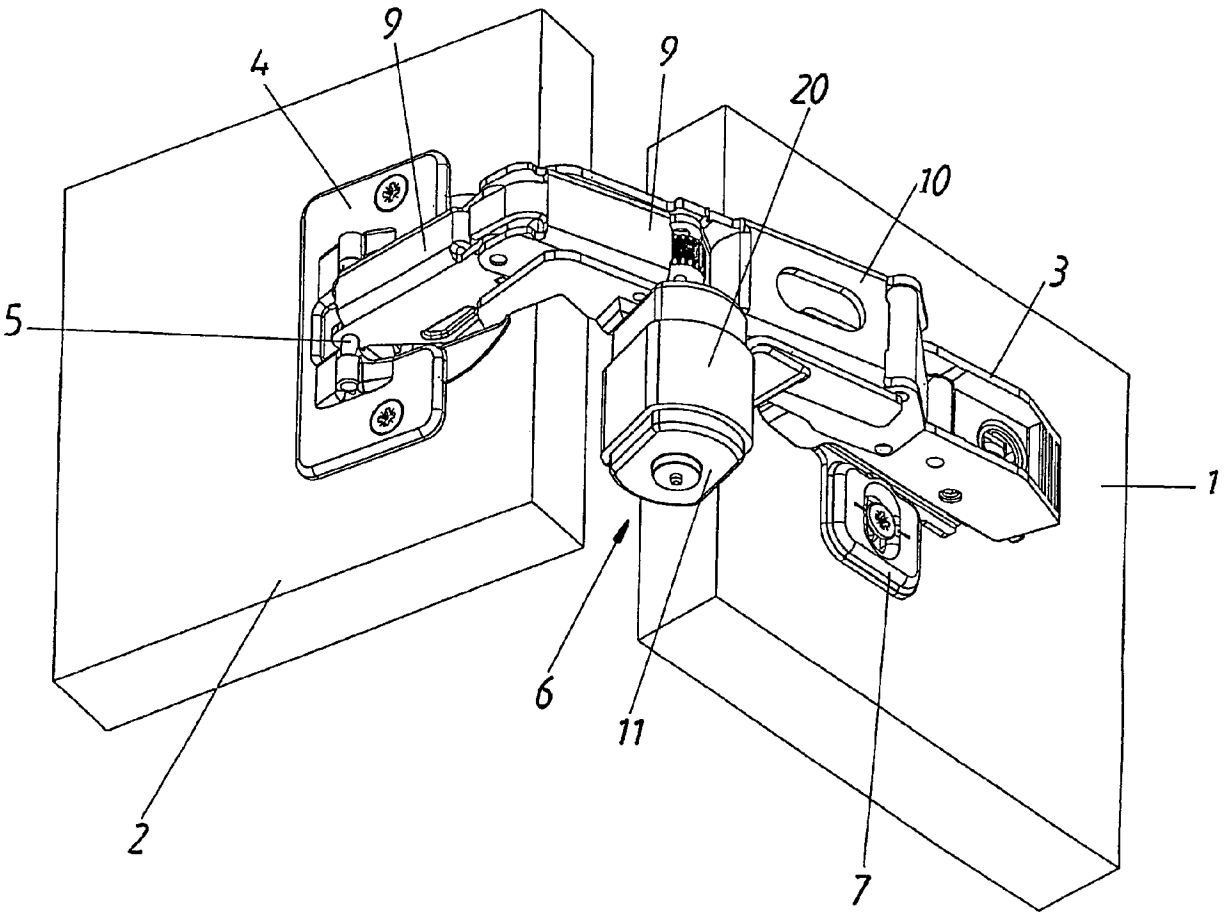
FIGS. 9 to 11 show an exemplary embodiment in which a rotational motor swivels the stop parts of what is known as a wide-angle hinge toward one another.
Figure 10:
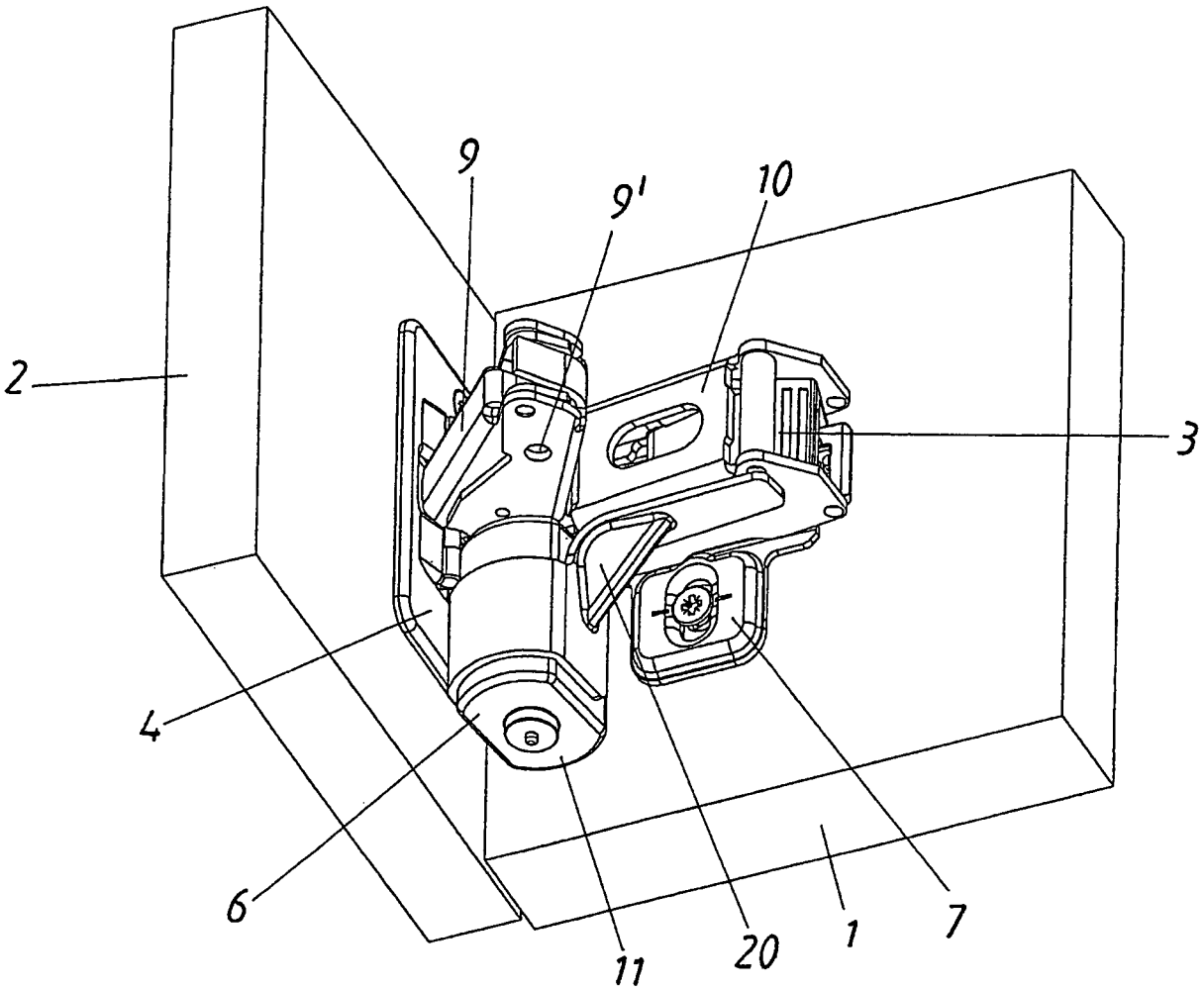
Figure 11:
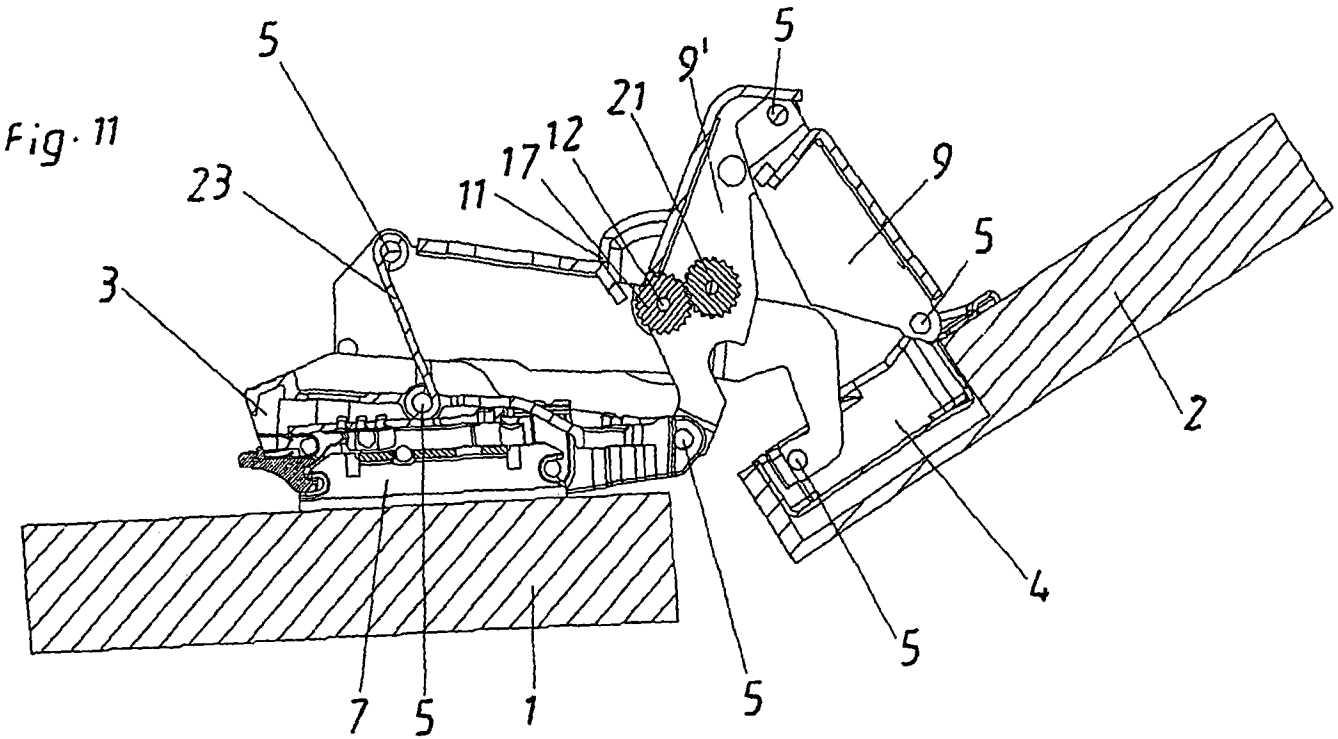

FIGS. 6 to 8 show an embodiment according to the invention in which the motor shaft 12 is arranged substantially perpendicularly to the articulated axles 5, 5'. In this case, it is advisable to provide a worm gearing comprising a worm wheel 18 between the motor shaft 12 and the driven articulated axles 5' or articulated levers 8'. The sectional views according to FIGS. 7 and 8, like the sectional views according to FIGS. 4 and 5, show through which components the rotational movement is transmitted from the motor shaft 12 to the articulated lever 8'. In this case too, the gear-wheel 19 is rigidly connected to the articulated axle 5' and the articulated lever 8'. The fastening bracket 20 holds the motor housing 11 in the optimum position for this arrangement, thus ensuring that the worm 18 engages with the gear-wheel 19. In the exemplary embodiment according to FIGS. 6 to 8, the encoder and the free-wheel or the coupling are integrated into the motor housing 11. They therefore cannot be seen from the outside. Obviously, these types of motors can in principle be used in all exemplary embodiments. Alternatively, it is also possible to use appropriate stepper motors.

FIGS. 9 to 13 show in exemplary embodiments how what are known as wide-angle hinges can be configured by motors 6 for swiveling the parts 1 and 2 of the item of furniture. Wide-angle hinges have in this case—as is known per se—seven articulated axles 5, 5', the outer articulated lever being configured in the form of two legs 9 and 9' which can be swiveled relative to each other. In the exemplary embodiment according to FIGS. 9 to 11, the motor housing 11 is arranged on an intermediate part 10 which can be swiveled relative to the hinge arm 3. At the same time, the motor shaft 12 forms one of the articulated axles 5'. The motor shaft mounts to a gear-wheel 17 which drives a second gear-wheel 21 which is rigidly fastened to the driven leg 9'. The arrangement of the gear-wheels 17 and 21 is shown particularly clearly in the sectional view according to FIG. 11, which also shows the lever 23 which allows, in conjunction with the leg 9', the intermediate piece 10 to swivel relative to the hinge arm 3.

Figure 12:
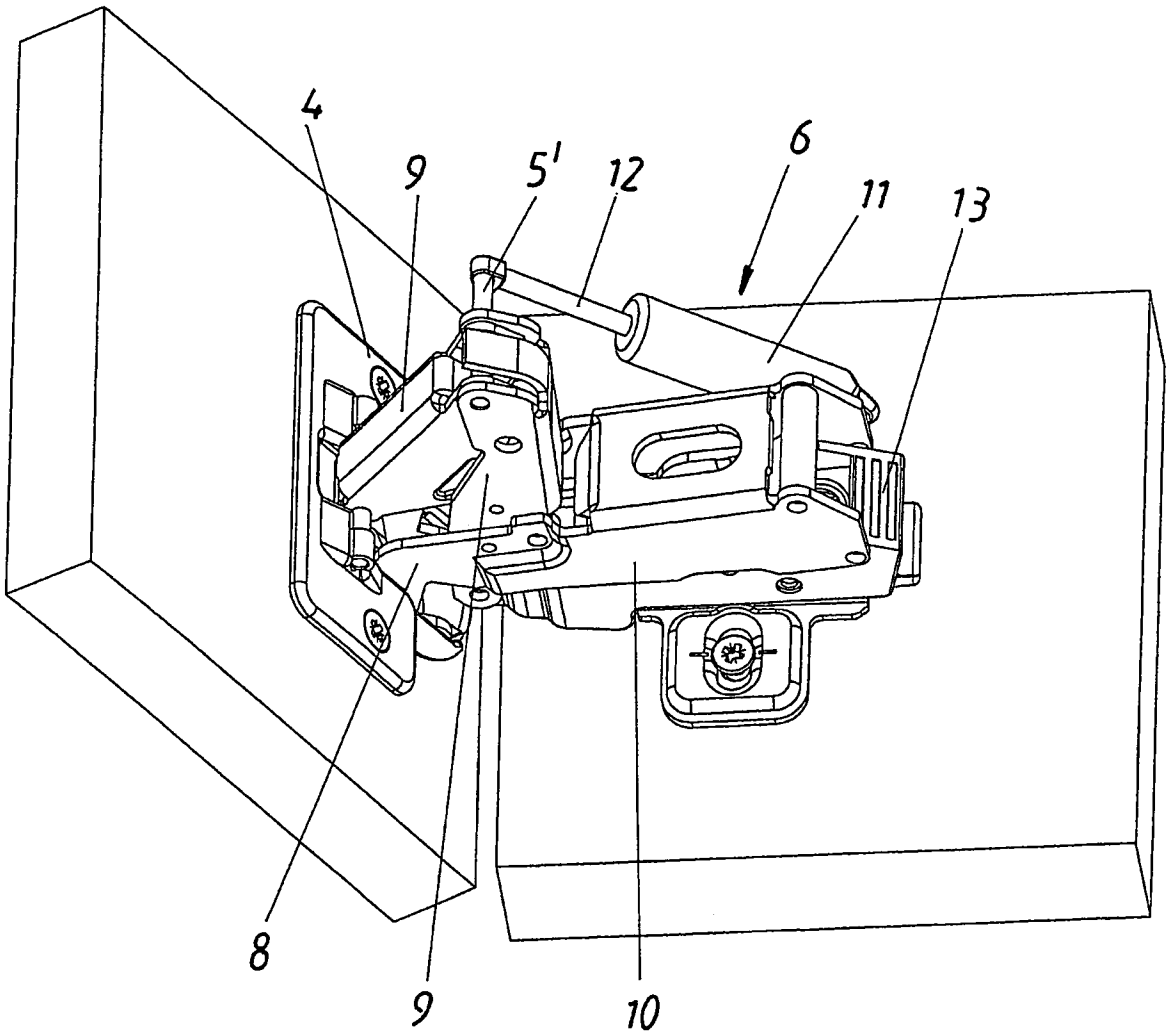
FIGS. 12 and 13 show a wide-angle hinge comprising a linear motor.
Figure 13:
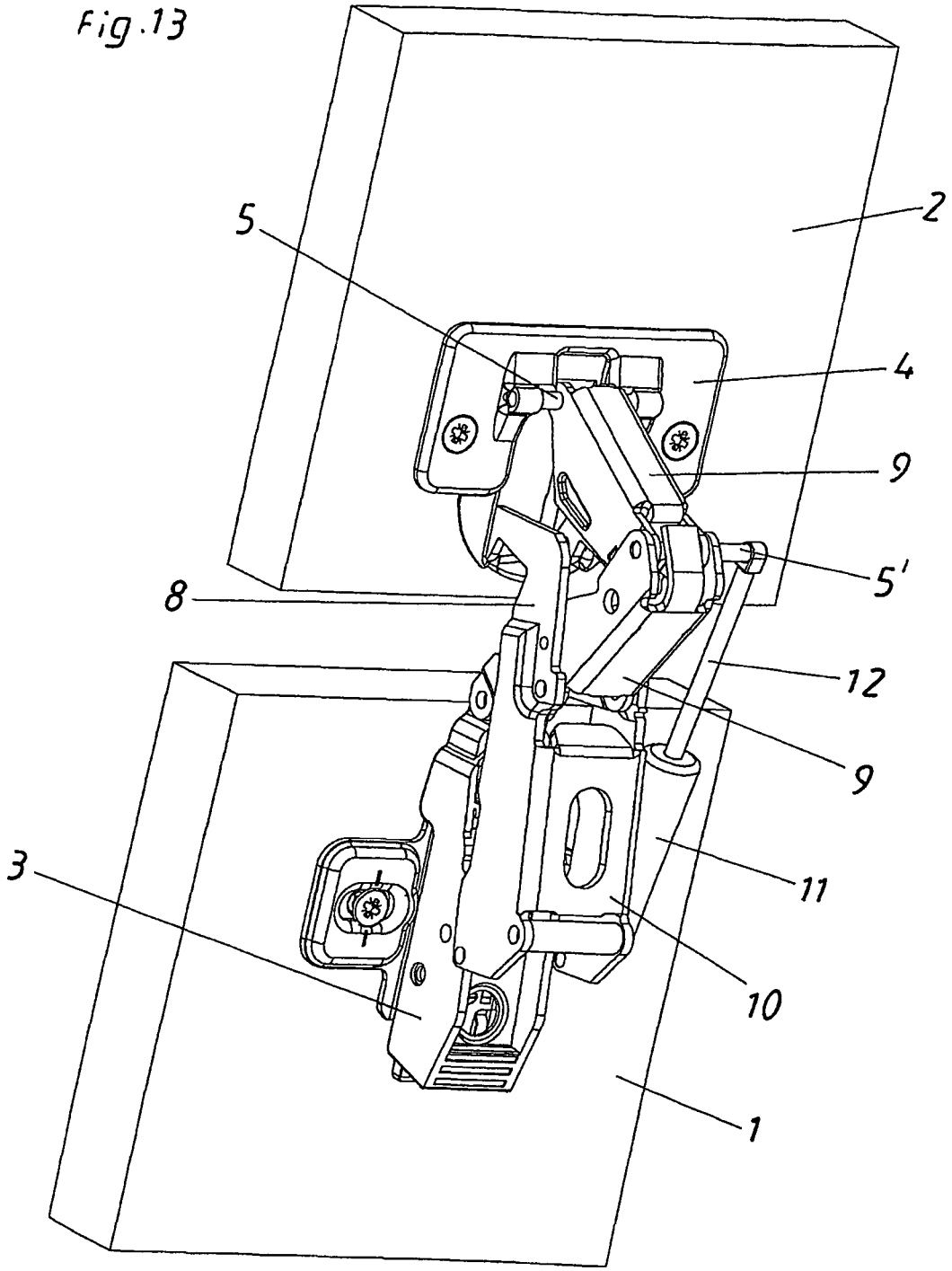

In the exemplary embodiment according to FIGS. 12 and 13, a linear motor is used instead of a rotational motor. Both the encoder for determining position and speed and the coupling or the free-wheel are beneficially also integrated into the linear motor. The movement of the hinge is brought about by extending or retracting the motor shaft 12 into the motor housing 11. In the exemplary embodiment shown, the motor housing 11 is arranged pivotably on the intermediate part 10 and the motor shaft 12 pivotably on the articulated axle 5'.

Figure 15:
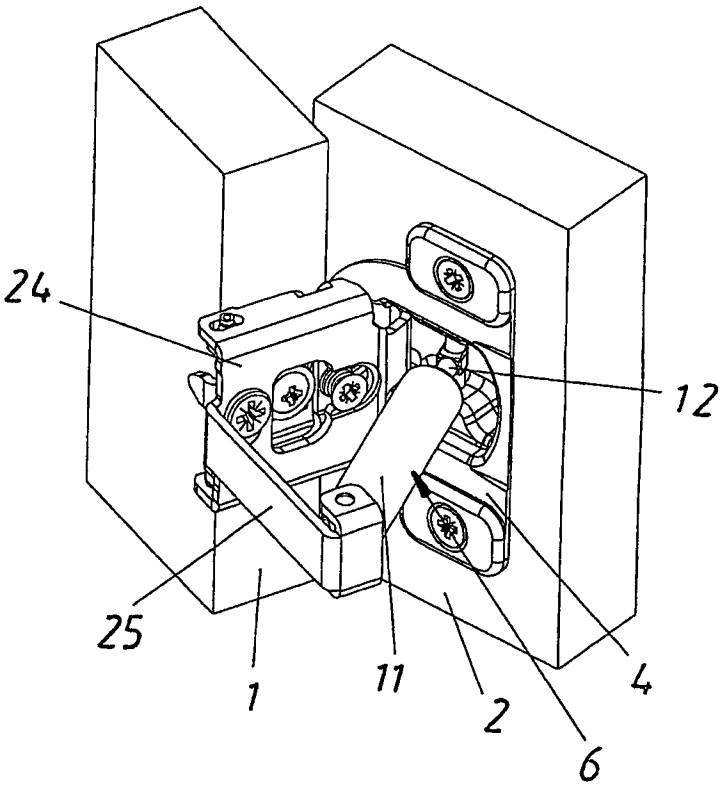
FIGS. 14 and 15 show what is known as a frame hinge comprising a linear motor.
Figure 14:
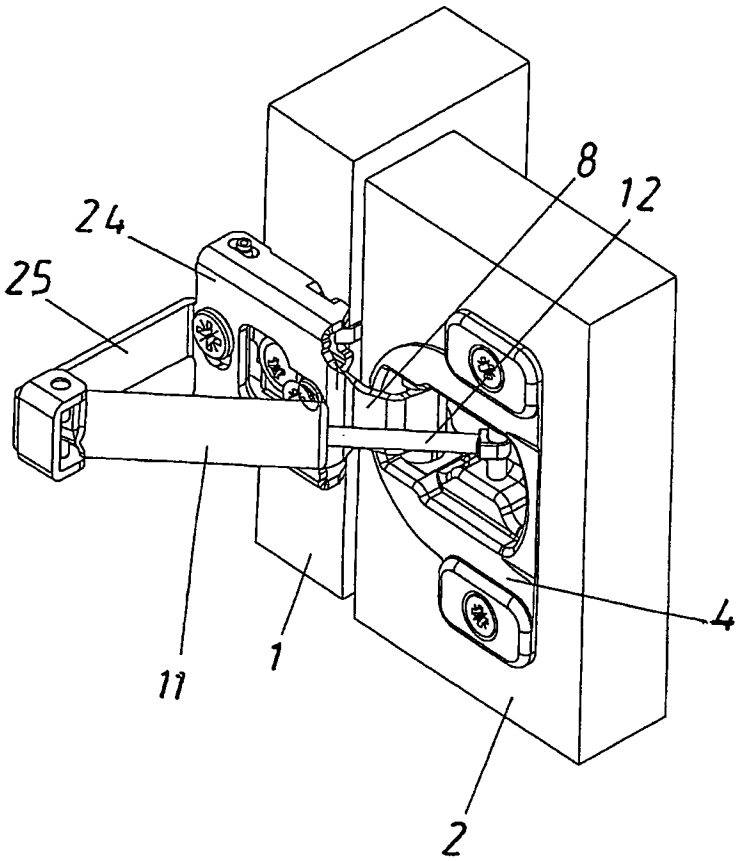

The embodiments according to FIGS. 14 and 15 show an example of how what is known as a frame hinge can be equipped with a motor 6—in this case a linear motor. Arranged for this purpose on the stop part 24 which can be fastened to the furniture frame 1 is a support lever 25 on which the motor housing 11 is pivotably supported. The motor shaft 12, which can be retracted and extended into the motor housing, is pivotably mounted in the hinge cup 4. As in all of the exemplary embodiments, in this case too it is beneficial to configure the transmission mechanism and motor so as not to be self-locking, so a manual opening and closing movement is possible—for example in the event of a power failure.

The activation or regulation of the motor 6 for swiveling the stop parts will now be described with reference to two schematic circuit diagrams according to FIGS. 16 and 17. It should be noted in this regard that, inter alia, all previously disclosed variations of how a motor 6 can be arranged on the furniture hinge are correspondingly regulatable or controllable.

Figure 16:
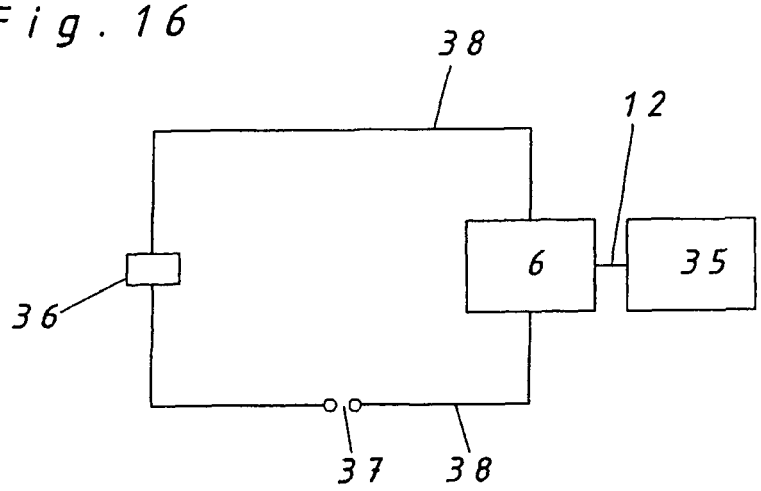
FIGS. 16 and 17 are two schematic circuit diagrams for carrying out the invention.

FIG. 16 shows a very simple exemplary embodiment. In this case, the motor is connected to a power source 37 and a switch 36 via power lines 38 which are not explicitly illustrated in FIGS. 1 to 15. The motor 6 swivels the stop parts of the furniture hinge 35 via the motor shaft 12. In a very simple embodiment, the—for example manually—actuatable switch 36 has three switching positions. In a first switching position, the motor 6 is activated in such a way that it drives the furniture hinge 36 into the open position. In a second switching position of the switch 36, the furniture hinge 35 is pivoted in the direction of the closed position. In the third position, the motor 6 is switched to a powerless state, so it then performs no movement. In this switching state, a coupling which is present in the motor 6 is beneficially opened or a free-wheel activated, so the furniture hinge can if needed be swiveled by hand. In addition to a manually actuatable switch 36, sensors which can be switched by a movement or exertion of pressure and/or tension on the stop parts or parts of the item of furniture may also be used. These sensors may, for example, be the aforementioned encoders 14 or potentiometers or other angle or distance-measuring systems such as, for example, optical sensors or the like. However, provision may also be made for the motor to have an inductive movement sensor by which it can be switched on and off, preferably as a function of direction, during a movement of the stop parts. If in the powerless state the coupling or the free-wheel is opened, a mechanical holding device, which hold the furniture hinge 35 in the resting state in the respective position, may beneficially be provided.

Figure 17:
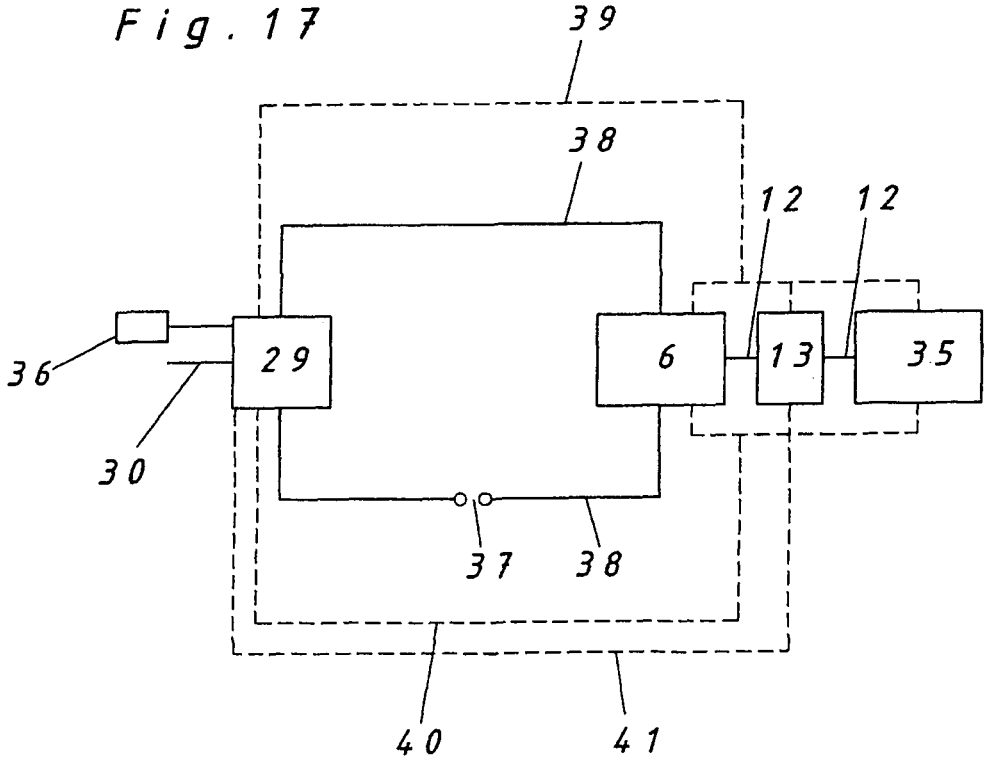

FIG. 17 shows a preferred arrangement in which a regulating device 29 regulates the opening and closing movements of the furniture hinge 35. The regulating device 29 can additionally be connected to an above-mentioned switch 36 and have further communication interfaces 30 for transmitting data or for transferring control software. The regulating device 29 is beneficially configured as a microcontroller. It activates the motor 6 preferably via the power line 38. It obtains the data about the actual position and/or actual speed of the stop parts of the furniture hinge 35 and a signal about the switch state of the coupling 13 from corresponding sensors in the motor 6 or in the furniture hinge 35 via a first data line 39. It obtains switching commands for swiveling the stop parts or for stopping the movement from sensors which can likewise be arranged in the motor 6 and/or in the furniture hinge 35 via a second data line 40.

Beneficially, provision is made to also use the sensors for determining the actual position and actual speed as sensors for the transmission of switching commands. Thus, for example, slight tapping or tugging on the part 2 of the item of furniture can be transmitted to an encoder or a potentiometer via the corresponding stop part.

This sensor then forwards the data via the first data line 39 to the regulating device 29 which interprets this signal, when an adjustable threshold is exceeded, as a command to swivel the furniture hinge and activates the motor 6 accordingly. The motor 6 can in this case be activated in such a way that it assists or fully takes over the movement started by hand on the part of the item of furniture. Thus, for example, in one embodiment of the switches 36, provision may be made for the switches to be arranged on the door handle and to react to a corresponding pressing or pulling movement on the door handle. The regulating device 29 can in this way swivel the furniture hinge 35 over predeterminable angular ranges in the opening or closing direction, approach the completely closed or open positions but also damp movements which are transmitted onto the part of the item of furniture with excessive manual vigor. Provision may also be made for the furniture hinge 35 to be brought into the completely closed or open position after a momentum is applied to the part of the item of furniture. Defined values or functions, in which a certain reaction to a detected application of force into the part of the item of furniture or the stop part is stored, can be stored in the regulating device 29 for accelerating and braking the stop parts or the motor shaft 12. Provision may also be made for the regulating device to bring the stop parts into the closed position if no new activation signal for opening and/or closing has been detected after a predetermined period of time. Obviously, the regulating device 29 preferably also activates the coupling 13 via the third data line 41 and switches the coupling at least between the closed and the opened state. The same applies to the free-wheel which may be provided. The regulating device 29 can be arranged separately but also on the furniture hinge or integrated therein.

Figure 18:
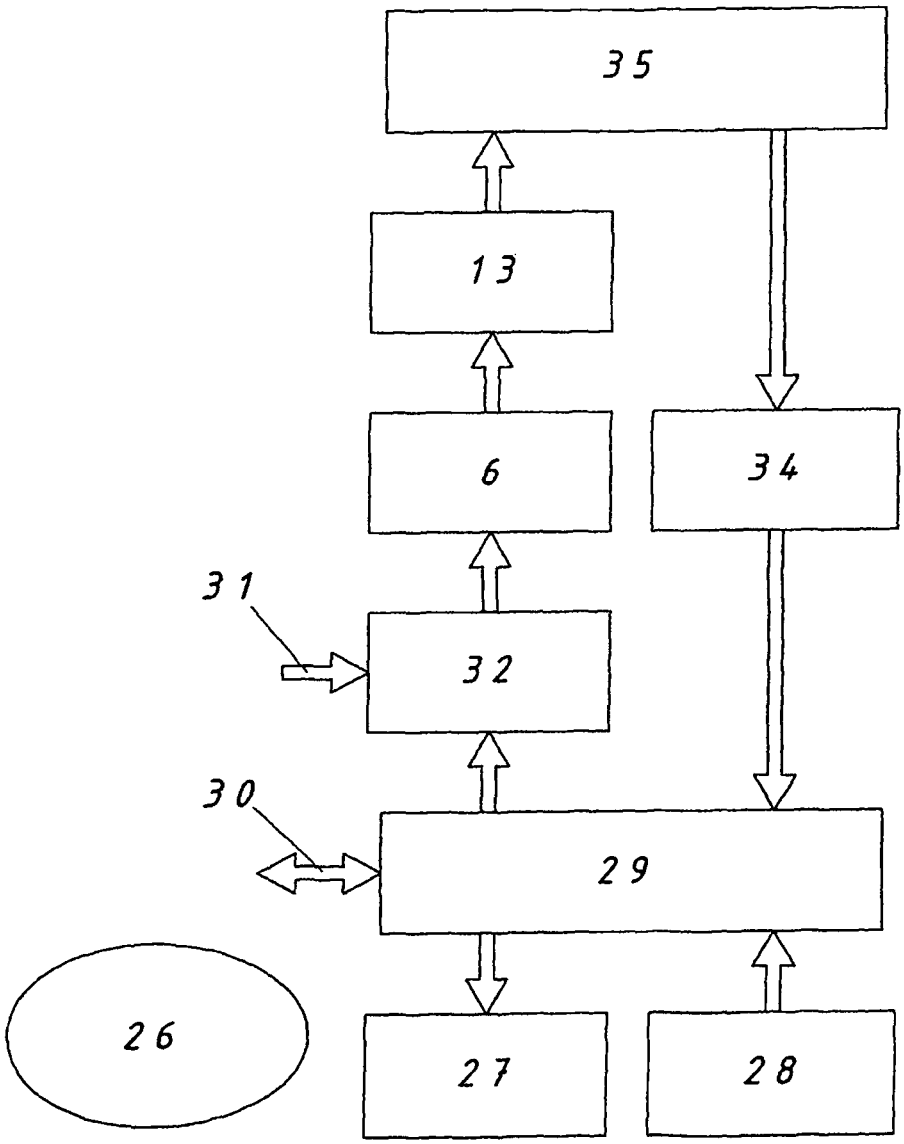
FIG. 18 is a control diagram according to the invention.

FIG. 18 shows a control diagram for the operation of a motor hinge according to the invention by regulation. The regulating device 29 regulates and monitors the movement process during opening, closing and braking or stopping. It activates a power actuator in the form of an amplifier stage 32. This electronic power output stage amplifies the signals of the regulating device 32 in order then to activate the motor 6 accordingly. The purpose of the motor 6 is both to convert—preferably electrical—energy into mechanical energy in order to swivel the parts of the item of furniture toward one another and to transform mechanical energy into, preferably electrical, energy during the braking process. The motor 6 can be coupled to the furniture hinge 35 to be moved, as stated hereinbefore, via a coupling system 13 and, if appropriate, also via a transmission mechanism for gearing down or up. The activation of the coupling 13 is also performed by the regulating device 29 via a signal line. During swiveling of the parts 35 of the item of furniture, the sensor system 34 converts the measured physical variables necessary for process management, such as the actual position, actual speed (optionally rotational speed), acceleration (optionally torque), into, preferably electrical, signals and delivers a standardized (bus-compatible) output signal to the regulating device 29. For this transfer of signals or data between the sensors system 34 and regulating device 29, either an analog interface (for example a 0 to 10-volt voltage interface) or a bus-compatible interface is used, depending on the complexity of the data exchange. An additional operating element 28 can be connected to the regulating device 29 via a corresponding analog or bus-compatible interface. The operating element 28 can be configured in the form of switches 36, specific actuating elements, for example for assisting manual actuation, or optionally also in the form of emergency cut-out switches. In addition, an indicating or display element 27 can optionally also be connected to the regulating device 29. In this case too, either an analog or a bus-compatible interface will be provided, beneficially depending on the type of the indicating element. Above all for the transferring of control and regulating software 26, it is generally beneficial if the regulating device 29 also has a communication interface 30 for parameterization and/or programming. This communication interface beneficially allows linking to a PC or the like and can also serve to exchange data with a possible superordinate control or regulating device which, for example, interconnects a plurality of drives. Generally, bus-compatible interfaces are used in this case too. Various components of the software 26 must be provided depending on the configuration of the regulating device 29. One of these components is used for process regulation and optionally for the autoparameterization of the regulating process. In addition, software components may also be provided to activate the interfaces. Various software components may also be provided for the diagnosis and parameterization of the drive. The entire movement process can thus be displayed during swiveling of the parts of the item of furniture. In addition, software may also be provided for the manual parameterization of the drive system and for the overall operation and diagnosis of the drive system. The energy supply 31 for feeding energy into the overall system is beneficially a 24-volt DC line. At the configuration of the energy supply it is generally to assume that a maximum mechanical power of approximately 5 watts is to be provided, yielding at an efficiency of approx. 25% an electrical power of the drive of approx. 20 watts.

Figure 19:
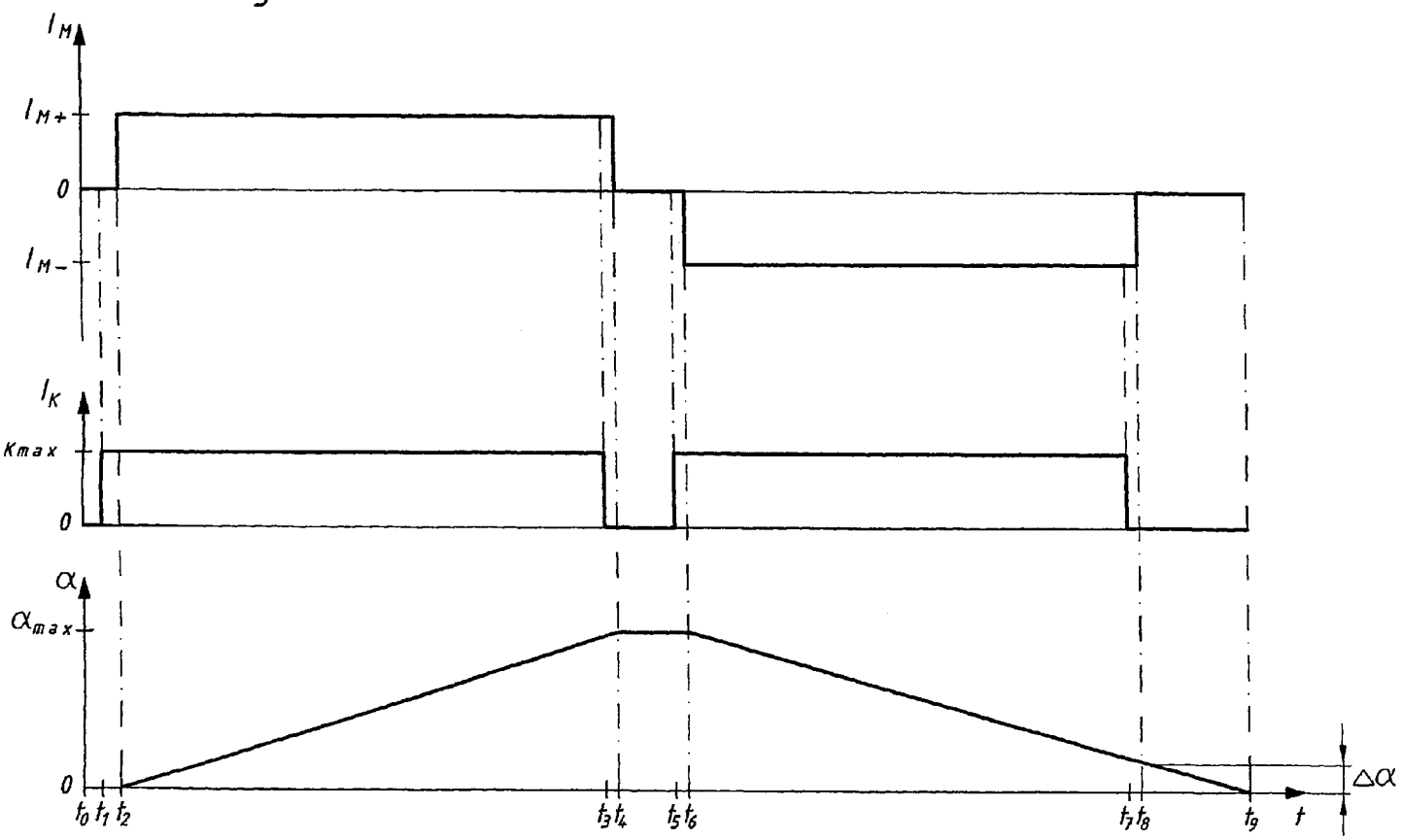
FIGS. 19 and 20 are schematic illustrations for an opening and closing movement respectively.

FIG. 19 is a sequence diagram for the motor-swiveling of two parts of an item of furniture that are connected via at least one furniture hinge according to the invention such as, for example, a furniture door and a furniture body. The opening angle $\alpha$—measured between the furniture door and furniture body, the coupling current $I_K$ and the motor current $I_M$ are plotted against a time axis t. $\alpha=0$ corresponds to the position of the closed door. $\alpha_{max}$ denotes the maximum opening of the door. At $I_{Kmax}$ the coupling is in the closed state. In this case, the force or the torque of the motor 6 is transmitted. At $I_K=0$ the coupling is opened. A motor current $I_M=0$ means that the motor is not rotating. At $I_{M+}$ the motor is rotating in the direction of the opening position, at $I_{M-}$ in the direction of the closed position. The following description of the sequence of movement will assume that at $t_0$ the command to open the door is issued via a switch 36. At the moment $t_1$ the coupling is closed. At the moment $t_2$ the motor starts up and the door begins to open. At the moment $t_3$ the coupling is opened and the door is braked by a mechanical braking system, such as for example a damper, before the open position is reached. At the moment $t_4$ the door reaches its maximum opening angle $\alpha_{max}$. The motor is turned off. Obviously, instead of a mechanical braking system, provision may also be made for the motor to be turned off prior to the opening of the coupling, i.e. prior to $t_3$, and to be resistance-loaded or short-circuited. It then performs the damping operation as long as the coupling is closed.

The motor and coupling are switched to a powerless state for as long as the door is to remain in the open position $\alpha_{max}$. The coupling is in this case opened. At the moment $t_5$ the switch 36 receives the command to close the door. The coupling is closed. At the moment $t_6$ the motor is switched on. It then closes the door, as may be seen from the course of $\alpha$. Before reaching the fully closed position ($\alpha$=0), the coupling opens at the moment $t_7$. The motor is turned off at the moment $t_8$. On the remaining closure path $\Delta\alpha$ the door is closed by a mechanical closure system known in the art. Alternatively, it is of course also possible to dispense with the mechanical closure system and to continue to operate the motor, with the coupling closed, for a correspondingly longer period of time until the door is closed. In this case too, the braking can be carried out by a motor or by a mechanical damper.

Figure 20:
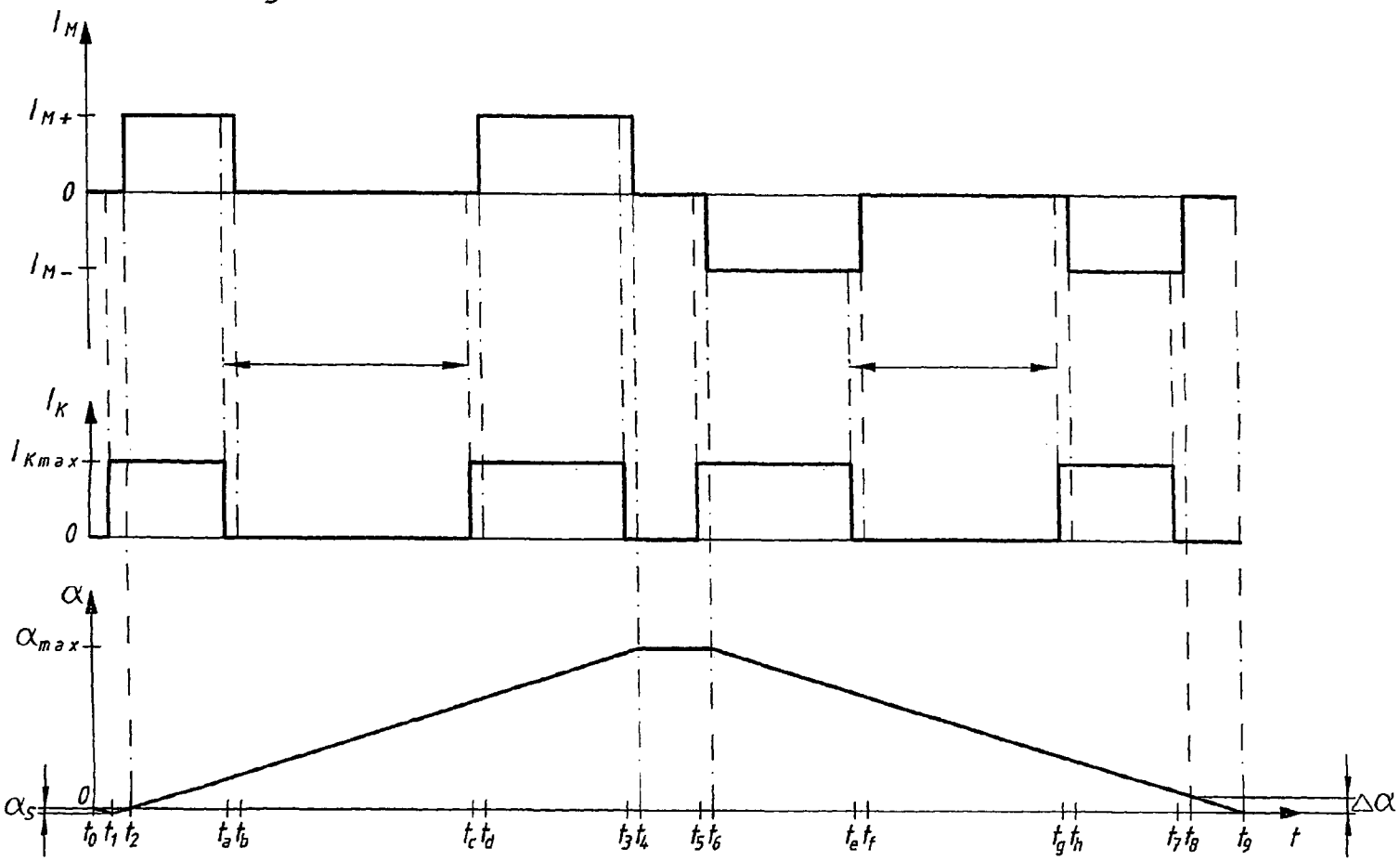

FIG. 20 shows the sequence of movement in an alternative form of the regulation. In this case, the closing and opening movement of the door is triggered not by actuation of a switch 36 or the like but rather by slight swiveling $\alpha_s$ of the furniture door. This swiveling is detected by an appropriate sensor, such as for example an encoder or potentiometer, and forwarded to the regulating device 29 which interprets the swiveling, when a preadjustable threshold is exceeded, as a switching command and closes the coupling at the moment $t_1$. At the moment $t_2$ the motor is switched on in order to open the door. On reaching a certain opening angle $\alpha$ at the moment $t_a$ the sensor system notices that the door is being accelerated manually by a user in the opening direction. The regulating device subsequently opens at the moment $t_a$ the coupling and switches the motor off at the moment $t_b$. At the moment $t_c$ the sensor notices that the door is no longer continuing to be moved by hand. The regulating device 29 switches the coupling back on at the moment $t_c$ and the motor back on at the moment $t_d$ in order fully to open the door. The remaining process up to the reaching of $\alpha_{max}$ corresponds to that of the example according to FIG. 19. The closing process also commences as from the moment $t_5$ as stated hereinbefore. The triggering at the moment $t_5$ can be carried out both via slight swiveling of the door, as at $\alpha_s$, or via a switch 36. Also during the closing of the door, the intervention of a person into the closing process is now shown. Thus, at the moment $t_e$ the sensor registers that the door is being manually accelerated. The coupling is opened. The motor is switched off at the moment $t_f$. At the moment $t_g$ the sensor registers the end of the actuation of the door by hand. The coupling is switched back on. The motor follows at the moment $t_h$ and closes the door until the mechanical closure system takes over the final closing on the remaining path $\Delta\alpha$.

Depending on the type of the parts of the item of furniture to be swiveled, it may be sufficient to assemble a furniture door with merely one motor-driven hinge and, in addition, a plurality of standard hinges.

The invention claimed is:

1. A furniture hinge for pivotably connecting at least two parts of an item of furniture, said furniture hinge comprising at least two stop parts which are each to be fastened to a respective one of said at least two parts of said item of furniture and are articulated to one another via at least one articulated axle, wherein said furniture hinge further comprises at least one electric motor for swiveling said stop parts;

wherein said motor has a motor shaft connected to at least one of said stop parts by a linkage including a coupling arranged in an output of said motor, said coupling being switchable at least between a coupled state in which said coupling transmits a force or a torque of said motor while said motor is operating, and an uncoupled state in which said coupling transmits no force or no torque of said motor while said motor is operating, said linkage further including a free-wheel.

2. The furniture hinge as claimed in claim 1, wherein at least one of said stop parts is a hinge cup.

3. The furniture hinge as claimed in claim 1, wherein at least one of said stop parts is a hinge arm.

4. The furniture hinge as claimed in claim 1, wherein said furniture hinge is a frame hinge.

5. The furniture hinge as claimed in claim 1, wherein at least one of said stop parts is clipped onto a base plate which is fastened to one of said at least two parts of the item of furniture.

6. The furniture hinge as claimed in claim 1, wherein said stop parts are joined together via at least one articulated lever.

7. The furniture hinge as claimed in claim 6, wherein said at least one articulated lever has two legs which can be swiveled relative to each other via at least one of said at least one articulated axle.

8. The furniture hinge as claimed in claim 1, wherein said free-wheel can be switched on and off.

9. The furniture hinge as claimed in claim 1, wherein said coupling comprises an electromagnetic coupling arranged in said output of said motor.

10. A furniture hinge for pivotably connecting at least two parts of an item of furniture, said furniture hinge comprising at least two stop parts which are each to be fastened to a respective one of said at least two parts of said item of furniture and are articulated to one another via at least one articulated axle, wherein said furniture hinge further comprises at least one electric motor for swiveling said stop parts, said stop parts being joined together via at least one articulated lever;

wherein said motor has a motor shaft connected to at least one of said stop parts by a linkage including a set of gears comprising a second gear-wheel or a second worm wheel engaged with a first gear-wheel or a first worm wheel arranged on said motor shaft, said second gear-wheel or said second worm wheel being arranged on said at least one articulated axle or said at least one articulated lever.

11. The furniture hinge as claimed in claim 10, wherein said motor shaft is arranged substantially perpendicular to at least one of said at least one articulated axle.

12. The furniture hinge as claimed in claim 10, wherein said motor has a motor housing, said motor shaft being mounted so as to be rotatable or longitudinally displaceable with respect to said motor housing.

13. The furniture hinge as claimed in claim 12, wherein said motor and said motor housing are arranged on one of said stop parts.

14. The furniture hinge as claimed in claim 12, wherein said motor and said motor housing are arranged on at least one of said at least one articulated lever.

15. The furniture hinge as claimed in claim 12, wherein said motor and said motor shaft acts on or is arranged on at least one of said at least one articulated axle.

16. The furniture hinge as claimed in claim 12, wherein said motor housing is arranged on one of said stop parts, and said motor shaft acts on at least one of said at least one articulated lever or on at least one of said at least one articulated axle of said furniture hinge or on the other of said stop parts.

17. The furniture hinge as claimed in claim 12, wherein said motor housing is arranged on one of said stop parts, and said motor shaft acts via a lever or toggle lever on at least one of said at least one articulated lever or on at least one of said at least one articulated axle of said hinge or on the other of said stop parts.

18. A furniture hinge for pivotably connecting at least two parts of an item of furniture, said furniture hinge comprising at least two stop parts which are each to be fastened to a respective one of said at least two parts of said item of furniture and are articulated to one another via at least one articulated axle, wherein said furniture hinge further comprises at least one electric motor for swiveling said stop parts, said motor having a motor shaft connected to at least one of said at least two stop parts by a linkage; and a determining device for determining an instantaneous relative position and/or an instantaneous relative speed of at least two of said at least two stop parts with respect to one another, said determining device being configured to determine the instantaneous relative position and/or the instantaneous relative speed of said at least two of said at least two stop parts with respect to one another by determining an instantaneous relative position and/or an instantaneous relative speed of said motor shaft of said motor with respect to a motor housing of said motor.

19. The furniture hinge as claimed in claim 18, wherein said determining device is an encoder or potentiometer, or said motor is a stepper motor.

20. The furniture hinge as claimed in claim 19, wherein said encoder or said potentiometer is configured to determine absolute values.

21. An arrangement comprising said furniture hinge as claimed in claim 18, further comprising a regulating device for regulating, using at least one actual value of said instantaneous relative position and/or said instantaneous relative speed of said motor shaft with respect to said motor housing, said motor for accelerating and/or for braking said stop parts depending on a defined value or a defined function.

22. The arrangement as claimed in claim 21, wherein said regulating device is configured to regulate said motor in such a way that said motor swivels taking into account at least one actual value of said instantaneous relative position and/or said instantaneous relative speed of said stop parts or of said motor shaft with respect to said motor housing, said stop parts over a predetermined angular range in the opening or closing direction.

23. A furniture hinge for pivotably connecting at least two parts of an item of furniture, said furniture hinge comprising at least two stop parts which are each to be fastened to a respective one of said at least two parts of said item of furniture and are articulated to one another via at least one articulated axle, wherein said furniture hinge further comprises at least one electric motor for swiveling said stop parts;

a determining device for determining an instantaneous relative position and/or an instantaneous relative speed of at least two of said stop parts with respect to one another; and a regulating device for regulating, using at least one actual value of said instantaneous relative position and/or said instantaneous relative speed of said stop parts, said motor for accelerating and/or for braking said stop parts depending on a defined value or a defined function;

wherein said motor has a motor shaft connected to at least one of said stop parts by a linkage.

24. The furniture hinge as claimed in claim 23, wherein said regulating device is configured to regulate, using at least one actual value of a movement sensor or of a pressure and/or tension exertion sensor, said motor taking into account said defined value or said defined function, in such a way as to trigger acceleration or braking of said stop parts.

25. The furniture hinge as claimed in claim 23, wherein said regulating device is configured to regulate said motor in such a way that said motor brings, depending on a signal of a movement sensor or of a pressure and/or tension exertion sensor, said stop parts into a closed or an open position.

26. The furniture hinge as claimed in claim 23, wherein said regulating device is configured to regulate said motor in such a way that said motor brings said stop parts, if said stop parts are in an opened position, into a closed position after a predetermined period of time.

27. The furniture hinge as claimed in claim 23, wherein said arrangement further comprises a movement sensor or pressure and/or tension exertion sensor which can be arranged on one of the parts of the item of furniture.

28. The furniture hinge as claimed in claim 23, wherein said furniture hinge further comprises a coupling arranged in an output of said motor, said coupling being switchable at least between a closed state in which said coupling transmits a force or a torque of said motor and an opened state in which said coupling transmits no force or no torque of said motor, wherein said regulating device is configured to switch said coupling between said closed state and said opened state.

29. The furniture hinge as claimed in claim 23, wherein said regulating device is arranged on said furniture hinge or is formed so that said regulating device and said furniture hinge are combined to have a one-piece construction.

* * * * *